US006926144B1

(12) United States Patent
Schnaars, Jr. et al.

(10) Patent No.: US 6,926,144 B1
(45) Date of Patent: Aug. 9, 2005

(54) BULK BAG PALLET TUBE APPARATUS

(76) Inventors: Daniel R. Schnaars, Jr., 602 Canberra Rd., Lafayette, LA (US) 70503; Matthew D. Schnaars, 110 Earline Dr., Lafayette, LA (US) 70506

( * ) Notice: Subject to any disclaimer, the term of this patent is extended or adjusted under 35 U.S.C. 154(b) by 135 days.

(21) Appl. No.: 10/228,634

(22) Filed: Aug. 27, 2002

(51) Int. Cl.[7] ..... B65D 19/00
(52) U.S. Cl. ..... 206/386; 206/596
(58) Field of Search ..... 206/600, 598, 206/596, 386; 383/21; 108/51.11, 51.3, 901

(56) References Cited

U.S. PATENT DOCUMENTS

| | | | | |
|---|---|---|---|---|
| 2,698,696 | A | 1/1955 | Strong | |
| 4,596,040 | A * | 6/1986 | LaFleur et al. | 383/7 |
| 4,830,191 | A | 5/1989 | Dijksman | |
| 5,031,776 | A * | 7/1991 | Morgan, IV | 206/600 |
| 5,465,865 | A | 11/1995 | Coombes | |
| 5,507,237 | A | 4/1996 | Barrow et al. | |
| 5,613,447 | A | 3/1997 | Trickett | |
| 5,785,175 | A | 7/1998 | Cholsaipant | |
| 6,213,305 | B1 | 4/2001 | Baker et al. | |
| 6,390,675 | B1 | 5/2002 | Jardine | |
| 6,467,625 | B2 * | 10/2002 | Baker et al. | 206/599 |
| 6,533,121 | B1 * | 3/2003 | Ross | 206/599 |
| 2002/0008517 | A1 * | 1/2002 | Derby et al. | |
| 2002/0139702 | A1 * | 10/2002 | Greene | |
| 2004/0025756 | A1 * | 2/2004 | Baker et al. | |

FOREIGN PATENT DOCUMENTS

| | | | |
|---|---|---|---|
| CA | 2394195 | * | 7/2002 |
| GB | 2085838 A | * | 5/1982 |
| JP | 409095389 A | * | 4/1997 |

* cited by examiner

*Primary Examiner*—Derris H. Banks
*Assistant Examiner*—Faye Francis
(74) *Attorney, Agent, or Firm*—Garvey, Smith, Nehrbass & Doody, L.L.C.; Gregory C. Smith

(57) ABSTRACT

An improved fabric bulk bag, of the type having wall portions, a top portion, and a floor portion, all defining a space for storing bulk therein, and further providing a pair of channels, substantially parallel in relation, secured along the outer surface of the floor portion, each channel having two open ends; a substantially elongated rigid U-shaped support member insertable into each channel, the upper wall of the member contacting the outer surface of the bulk bag, and the two arms of the U-shaped member providing a travel space through the channel for receiving the tynes of a forklift, and allowing the tynes to contact the upper wall of the member when the bag is lifted; the two arms of the member also providing a stable pallet-like foundation for the bag when the bag is positioned atop another filled bag. There is further provided finger-like openings between the walls of the U-shaped member and the channels, to secure the edges of each channel to maintain the U-shaped member within each channel when the forklift tynes are engaging or disengaging from the channels. There is further provided blocks along the outer walls of the channel walls for filling any gaps between the fabric channels and the U-shaped members inserted therein.

13 Claims, 8 Drawing Sheets

FIG. 1
PRIOR ART
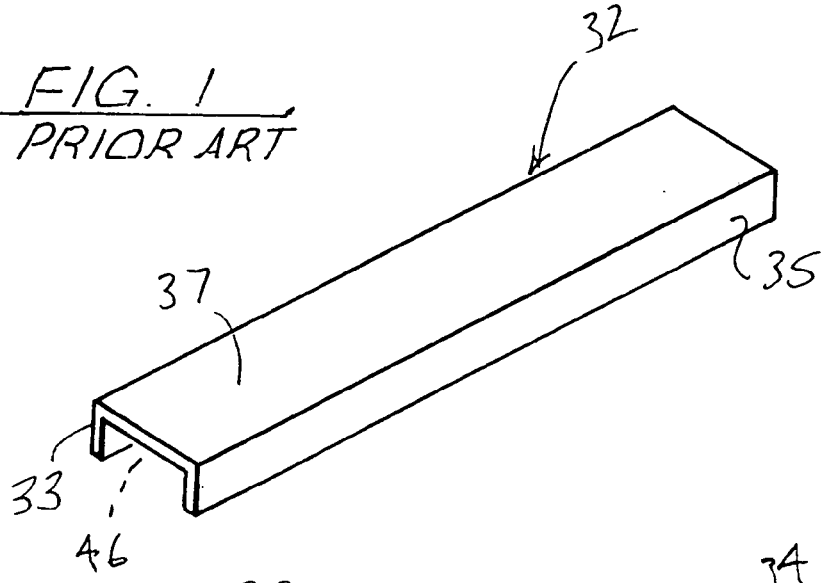
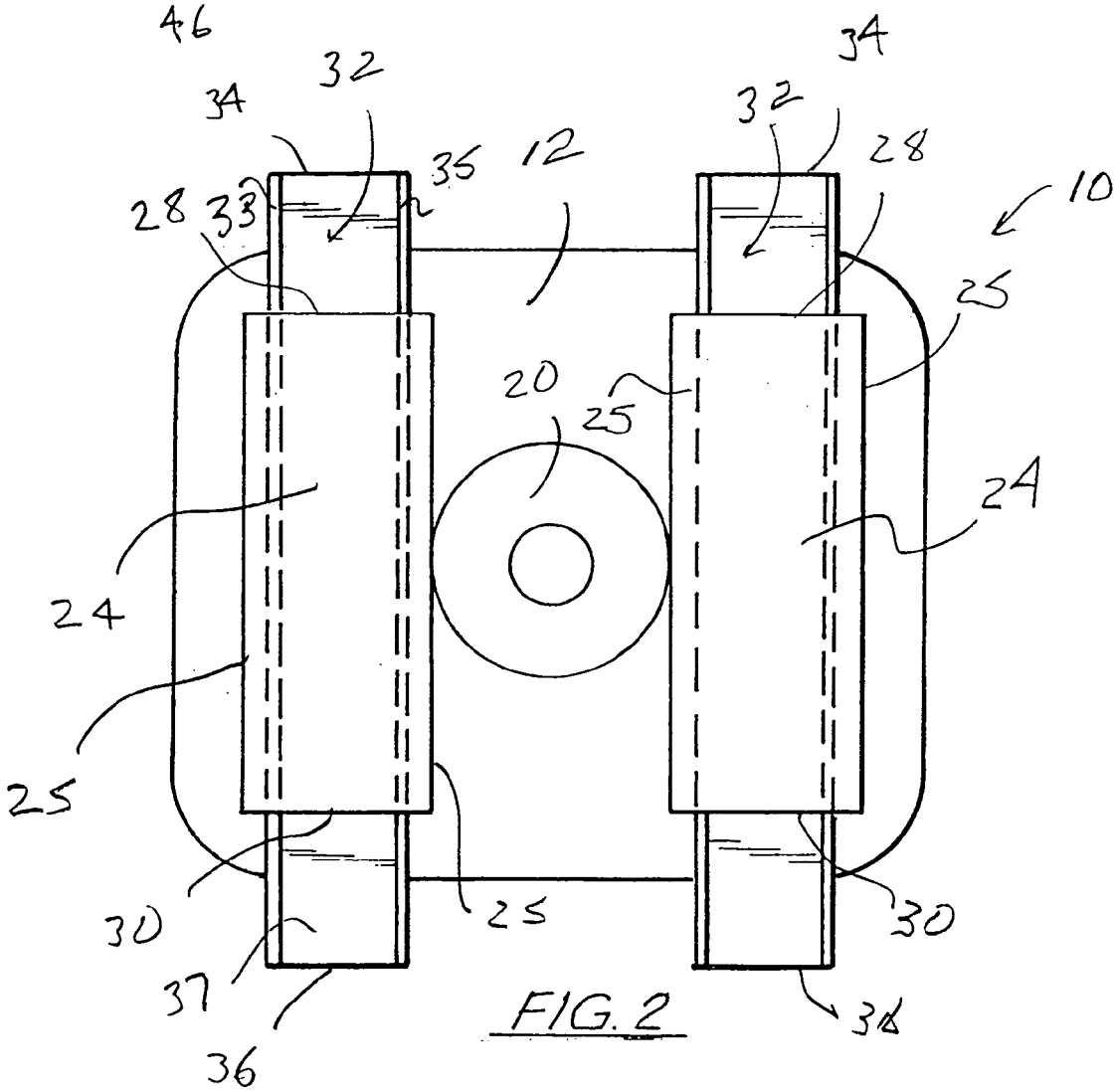
FIG. 2

BULK BAG PALLET TUBE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fabric bulk bags. More particularly, the present invention relates to a bulk bag having a floor portion which includes a pair of spaced apart pockets for receiving a rigid member to define a channel through which tynes of a forklift may enter, for lifting the bag, and the rigid members being maintained in the pockets for defining a flat surface for the bag to rest upon the floor or other bags.

2. General Background of the Invention

Bulk bags are for the most part bags constructed of a polypropylene material which would normally be of the type having four side walls, a bottom wall, a top wall and means such as loops for lifting the bag with a forklift after the bag has been loaded with bulk. The prior art bulk bags utilized the lifting loops at each corner in order to lift the loaded bag, which may weigh thousands of pounds, so that the filled bags may be stored in a warehouse or the like. Lifting loops are difficult to access by a forklift and usually takes a second person to assist. When filled, bulk bags may also be moved on pallets. Pallets, although easily accessible, are usually made of wood, and over time will be susceptible to splintering, mold, or insects. Plastic pallets may eliminate these problems, but are very expensive to produce.

One problem with transporting and storing bags of this type is that the bags, in order to conserve space, would typically be stacked upon one another to a height, so long as the bags did not risk of toppling over. However, because of the soft underside of the bags, when the bags, filled with dry, powdery bulk, are stacked upon one another, the bulk within the bag may shift, and in doing so, may cause the bag to lose its center of gravity and fall from its resting place, which could be both dangerous to persons working in the area, and cause the loss of thousands of pounds of what may be expensive bulk material.

Therefore, there is a need in the industry for a bag which, when filled with bulk material, can be easily and safely transported by a forklift, and can be safely and securely stored atop other filled bulk bags, so that the possibility of the filled bag falling from its perch due to shifting of material, or deforming its floor portion, is eliminated.

In U.S. Pat. No. 6,213,305, entitled "Bulk Bag," the patent disclosed the use of two rigid members placed within sleeves on the bottom of the bag, the rigid members formed to receive tynes of a forklift through the opening formed by the members. The members were secured within the sleeves with elastic bands. This attempt has fallen short of solving the problems in several reasons. First, the elastic bands need sufficient tension to hold the rigid members within the channel, which is difficult. Also, the rigid members, if not properly secured within the channels will tend to slide from the channels when the tynes of the forklift go into or out of the sleeves. Also, plastic inserts, which have been provided which are thick, extruded plastic, rectangular tubes. Such four-sided tubes cannot be nested when shipped or stored. Additionally, the rigid inserts do not provide any protection to the sleeves making direct contact with the floor where a bag may be slid along the floor, thus wearing or even tearing the sleeves on the bottom of the bag.

Therefore, there is a need for improving the art of inserts into channels on the floor of bulk bags which solves these aforesaid problems.

Applicant is submitting herewith the prior art statement regarding patents which have been reviewed which may be pertinent to the subject matter of this invention.

BRIEF SUMMARY OF THE INVENTION

The improved bulk bag of the present invention solves the problems in the art in a simple and straightforward manner. What is provided is an improved fabric bulk bag, of the type having wall portions, a top portion, and a floor portion, all defining a space for storing bulk therein, and further providing a pair of channels, substantially parallel in relation, secured along the outer surface of the floor portion, each channel having two open ends; a substantially elongated rigid three-sided U-shaped support member insertable into each channel, the upper wall of the member contacting the outer surface of the bulk bag, and the two arms of the U-shaped member providing a travel space through the channel for receiving the tynes of a forklift, and allowing the tynes to contact the upper wall of the member when the bag is lifted; the two arms of the support member-also providing a stable pallet-like foundation for the bag when the bag is positioned atop another filled bag. There is further provided finger-like openings between the walls of the U-shaped member and the channels, to secure the edges of each channel to maintain the U-shaped member within each channel when the forklift tynes are engaging or disengaging from the channels. There is further provided blocks along the outer walls of the channel walls for filling any gaps between the fabric channels and the U-shaped members inserted therein. An additional embodiment may provide cut away portions along the channel walls for defining portions of the support member wall to make direct contact with the surface upon which the bag rests to avoid contact between the bag sleeves and the surface.

Therefore, it is a principal object of the present invention to provide an improved bulk bag which can be easily and safely transported by forklift and safely stacked on another filled bulk bag.

It is a further principal object of the present invention to provide an improved bulk bag which includes a pallet support structure incorporated therein.

It is a further object of the present invention to provide a bottom portion of the bag adapted with rigid members for defining a level, secure means to both transport the filled bag and allow the bag to be safely stacked on other such bulk filled bags.

It is a further object of the present invention to provide support members insertable into sleeves on the bottom of a bulk bag which allows the support members to contact the surface upon which the bag rests without contacting the sleeves.

It is a further object of the present invention to provide rigid inserts for bulk bags made of high density polyethylene which can be injection molded rather than extruded plastic, to allow for geometric shaping of the insert and to use a variety of plastic materials.

It is a further object of the present invention to provide plastic inserts for bulk bags which are inexpensive to mold, and can be nested when shipped or stored.

It is a further object of the present invention to provide removable inserts which are not permanently positioned within sleeves on bag bottoms allowing the inserts to be easily positioned into and removed from the bag, do not have to be shipped with the bags, and easily removed when refurbishing of the bag is necessary.

It general, it is an overall object of the present invention to provide a three sided insert for cost reduction and nestability, which can protect the fabric of the bag, and injection molded to allow for geometric shaping that strengthens the inserts against deflection.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 1 illustrates an overall view of a U-shaped member insertable into a sleeve in a bulk bag currently known in the art;

FIG. 2 an underside view of a bulk bag incorporating the sleeves to accommodate U-shaped members therein;

DETAILED DESCRIPTION OF THE INVENTION

FIG. 1 illustrates a generally three-sided insert 32 which is known in the art, insertable into sleeves formed on the lower end of a fabric bulk bag, the insert 32 including an upper wall 37 with two side walls 33, 35 formed along its length. This insert would be a very basic insert which would not include any of the improvements as will be discussed in relation to the present invention.

Figure 7:
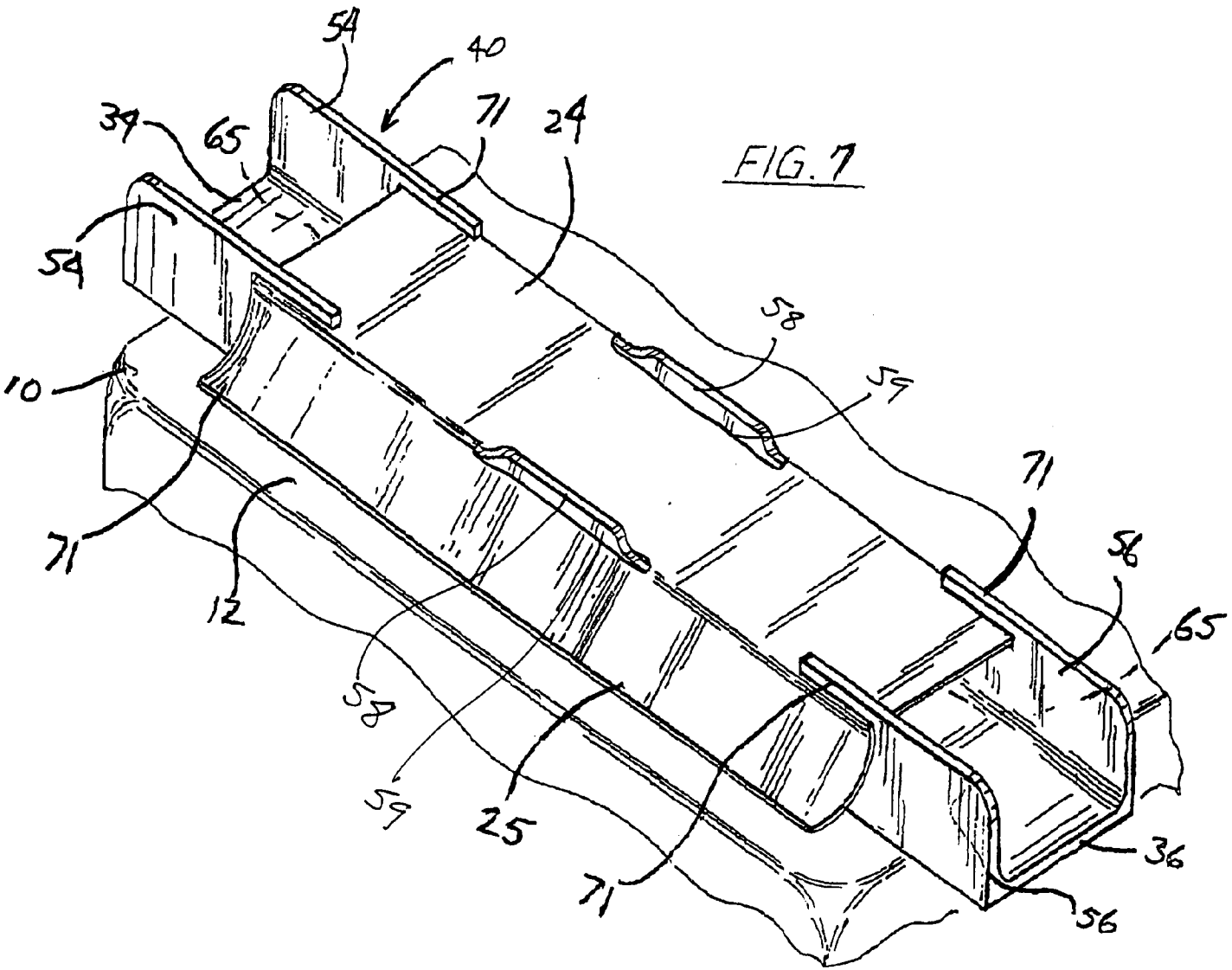
FIG. 7 illustrates a partial view of the U-shaped member in FIG. 6 within a sleeve of the bulk bag.
Figure 8:
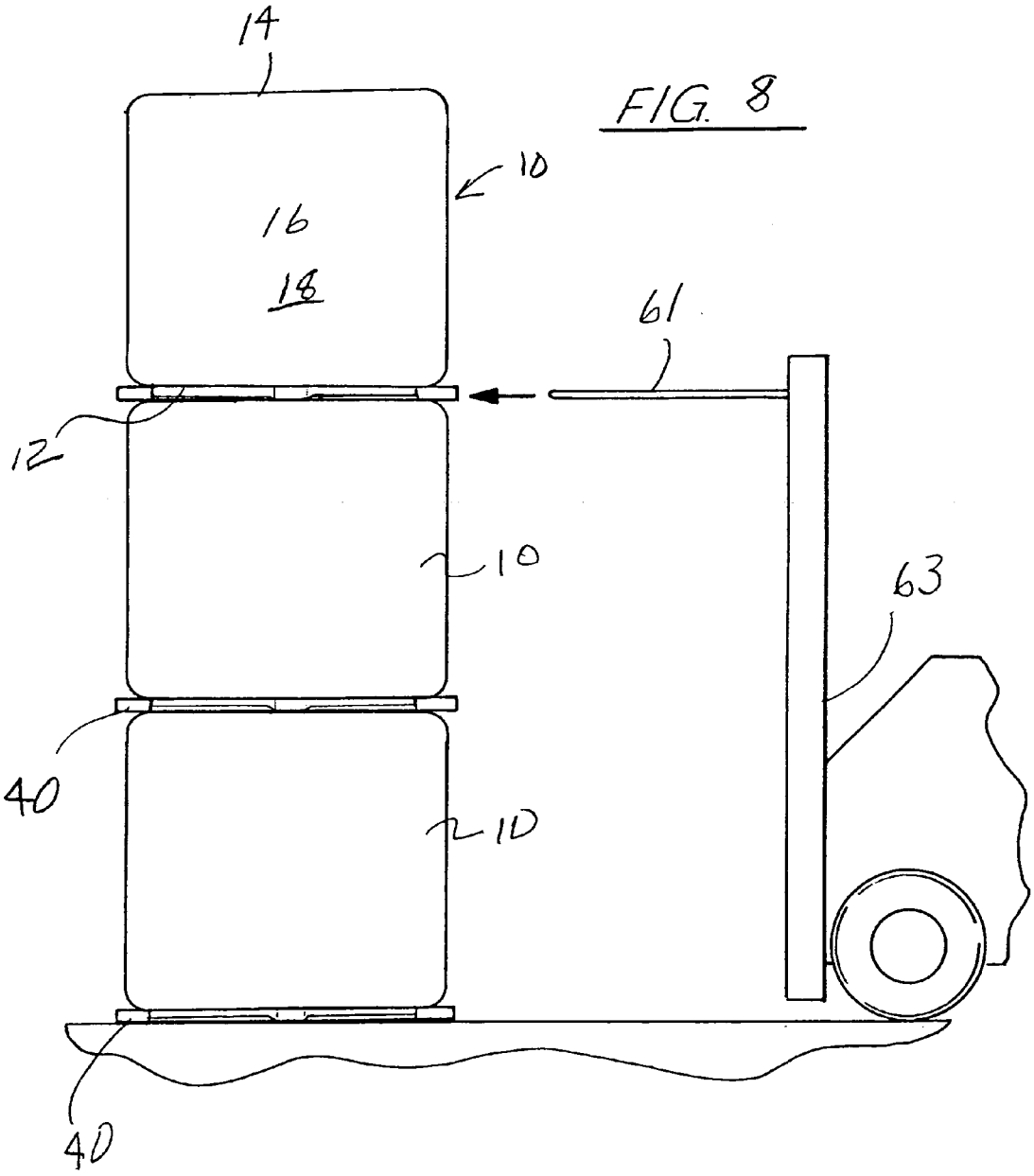
FIG. 8 illustrates a plurality of the improved bulk bags of the present invention stacked upon one another and being approached by a forklift.

As illustrated in FIG. 2, there is illustrated the underside 12 of a bulk bag 10, of the type having a top wall 14, side walls 16, which are illustrated more fully in FIGS. 7 and 8. In most cases the bulk bag 10 would have an opening in its top wall through which bulk material is poured into the bag space 18, and an opening 20 on its underside 12 for allowing the bulk to flow from the bag space 18, when the normally closed opening 20 is opened. The opening 20 would usually include a down spout for allowing the bulk material to flow into another vessel or the like. These features are quite common in most bulk bags.

Turning again to FIG. 2, there is illustrated the underside 12 of bulk bag 10, including a pair of fabric sleeves 24 stitched, or secured in other ways, along the edges 25 so as to define an opening 26 between the sleeve 24 and the underside 12 of the bulk bag 10. As illustrated the sleeves 24 are open at their two ends 28, 30, which would allow a support member 32, as illustrated, to be slidingly engaged through the opening 26, with the ends 34, 36 of the member 32 extending beyond the ends 28, 30 of the sleeves, although this is not necessarily required. As is further illustrated the sleeves 24 are positioned substantially parallel to one another on the underside 12, and spaced sufficiently apart so as to allow the tynes 61 of a forklift 63 to slide into each sleeve when the filled bulk bag 10 is being lifted and moved, as will be discussed further. Again, the member 32 illustrated in FIGS. 1 and 2 would confront the problems of not protecting the fabric sleeve 24 from abrasive contact with the floor, and would have the problem of being unsecured within the sleeves 24, therefore, susceptible to being pushed from or pulled out of the sleeves during maneuvering of the bag by a forklift. The embodiments of the present invention would solve these problems, as illustrated in FIGS. 3 through 9.

Figure 3:
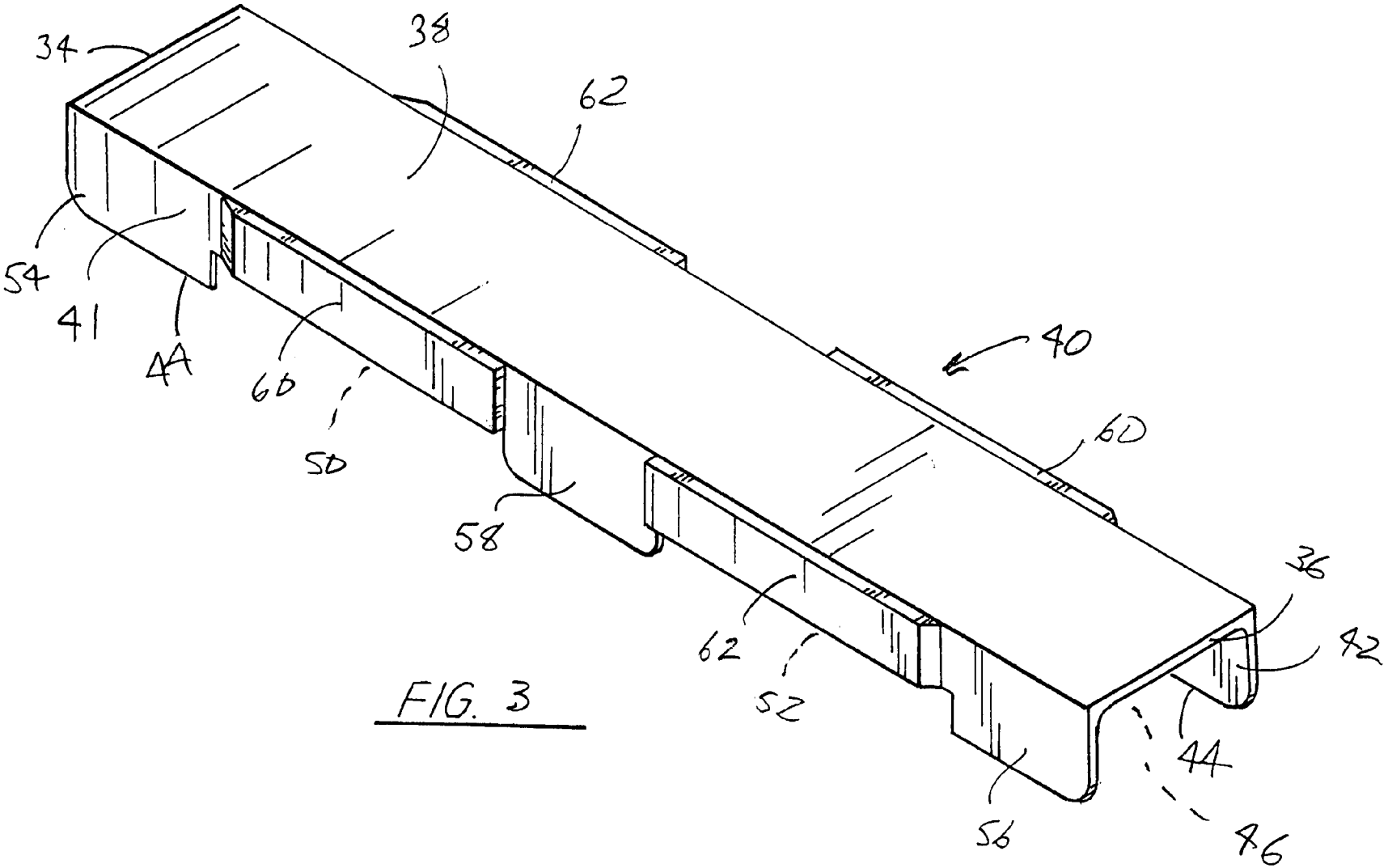
FIGS. 3 and 4 illustrate top and bottom views respectively of a preferred embodiment of the U-shaped member of the present invention insertable into a bag sleeve of the type illustrated in FIG. 2.

Reference is now made to FIG. 3, where there is illustrated in overall view one of the improved members or inserts 40 of the present invention. It should be noted that the members 40 may come in several embodiments as seen in FIGS. 3 through 9, but all perform the principal function as will be described herein. As seen in FIG. 3, member 40 comprises a first upper wall portion 38, with a pair of side portions 41, 42 extending downward therefrom, and terminating in a lower edge 44 along the length of each side 41, 42. The support member would be substantially three sided and U-shaped, having no lower wall portion, as seen. This would allow for nesting of the members 40 together for ease and compactness for shipping. The U-shape of member 40, as seen in the Figures would define an opening 46 throughout its entire length, the function of which will be defined further. For purposes of construction, the members 40 would be injection molded high density polyethylene (HDPE), or be formed of some other suitable, equivalent material, but in each case sufficiently strong to support the weight of a filled bulk bag, yet geometrically shaped to strengthen the members 40 against deflection; and each side wall 41, 42 may have a 10 degree angle to strengthen the walls against uneven floors. Also, the corners 43 of each of the side portions 41, 42 are rounded to allow the members 40 to easily inserted into sleeves 24 without snagging the fabric.

Figure 4:
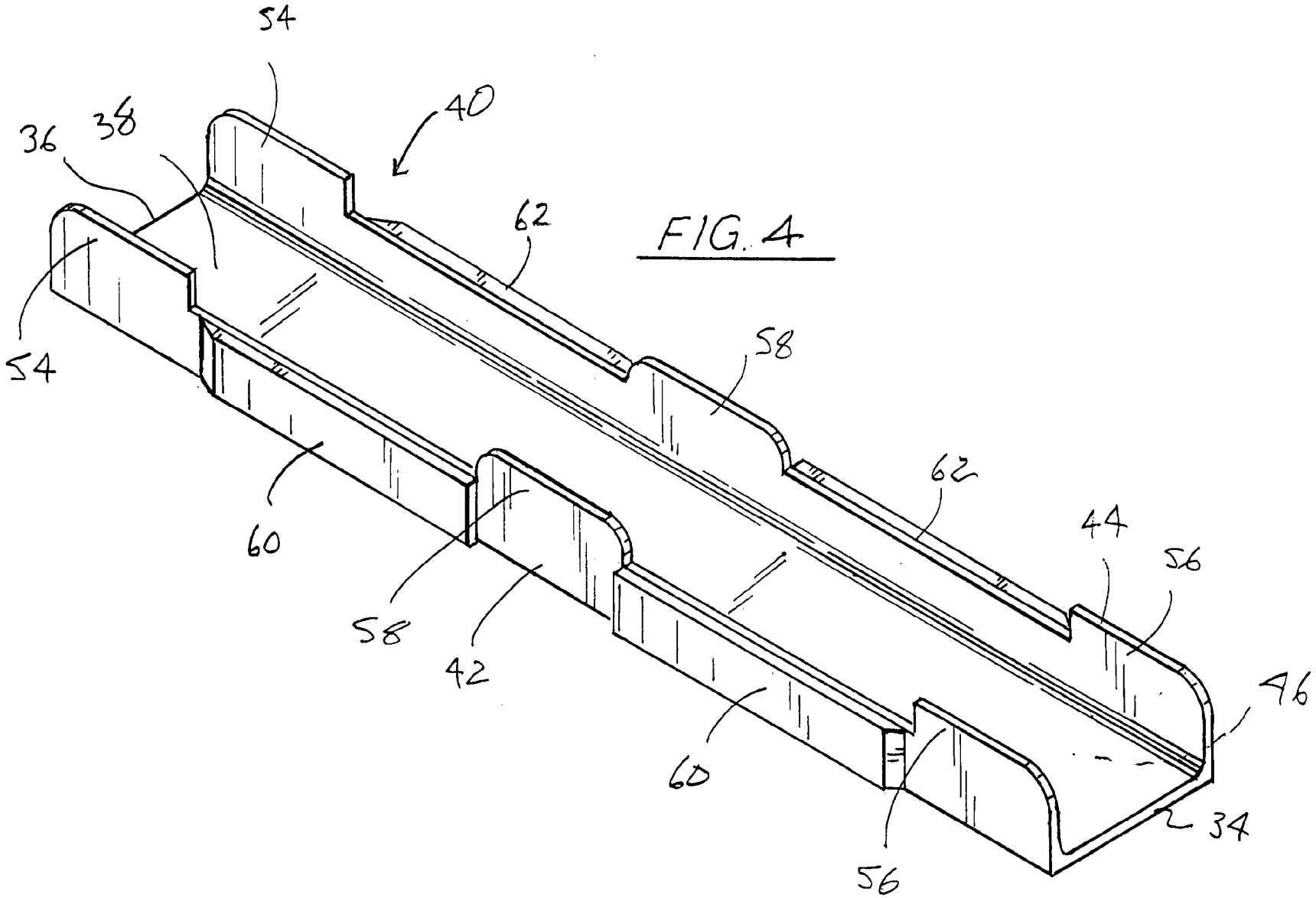

As seen further in FIGS. 3 and 4, in this embodiment, each of the side walls 41, 42 would include a pair of recessed areas 50, 52 along their length, so as to define a foot portion 54 at a first end, a foot portion 56 at a second end, and a central foot portion 58. Likewise the side walls 41, 42 would include a pair of raised members 60, 62 along their length, between the foot portions 54, 56 and 58, the function to be described below.

Figure 5:
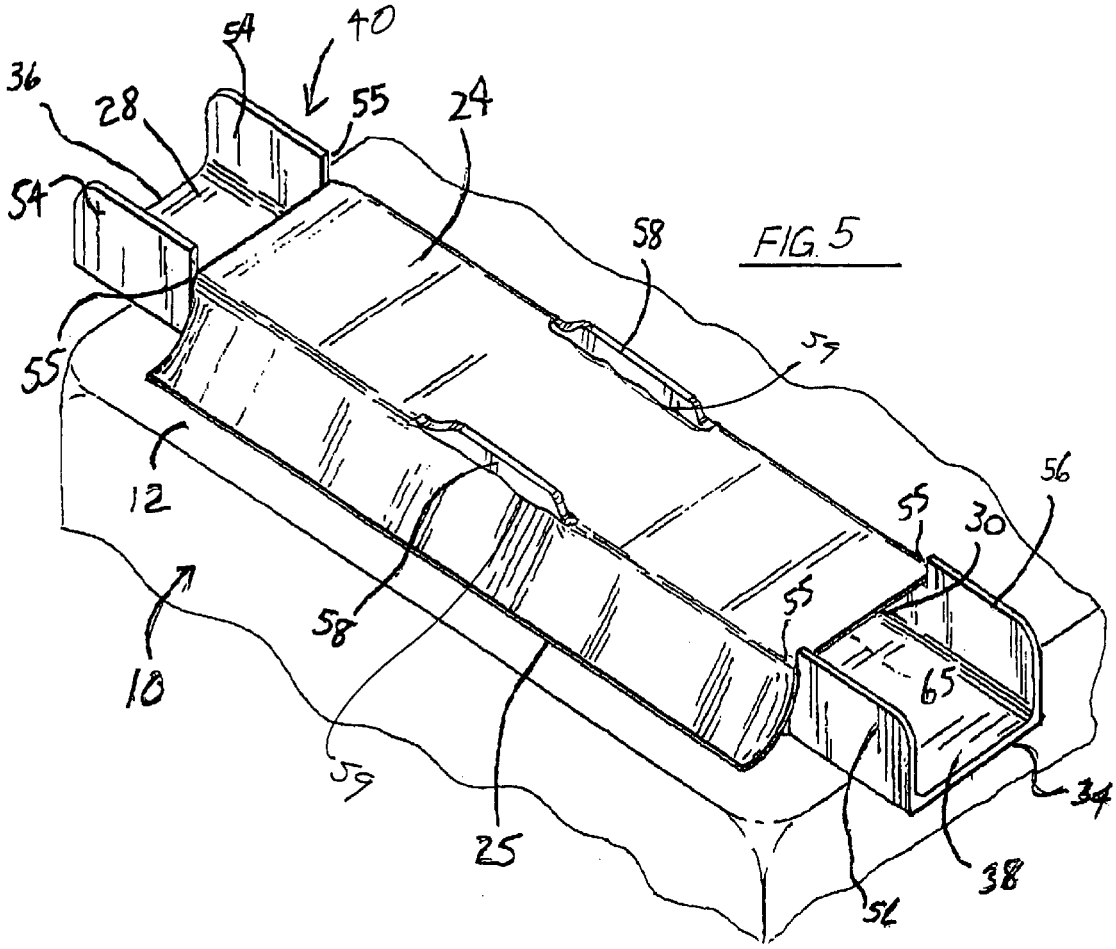
FIG. 5 illustrates a partial view of the U-shaped member of the present invention in FIGS. 3 and 4 secured within a sleeve of the bulk bag.

Reference is now made to FIG. 5, where there is illustrated the embodiment of the member 40, as illustrated in FIGS. 3 and 4, having been slidingly engaged into a sleeve 24, of the type as seen in FIG. 2. As seen, feet 54, 56 are spaced a distance apart so that when the member 40 is slid into sleeve 24, the ends 28, 30 of sleeve 24 rest on the interior edges 55 of feet 54, 56. Also, the raised members 60, 62 along the length of each member 40 make the circumference of the recessed areas 50, 52 of the walls 41, 42 of member 40 equal to the circumference of the foot portions of the member 40 so that the sleeve 24 is pulled tightly across the walls 41, 42 of the member 40, and the opening 65 between the sleeve 24 and the upper wall 38 is well defined. As illustrated, when the member is placed within the sleeve 24, and the sleeve engaged, the upper wall 38 is resting against the underside 12 of bulk bag 10, and there is a travel space 65 provided which will provide an unobscured opening for the forklift tynes 61 to enter each sleeve 24 to lift and move the bulk bag 10. Also, because the sleeves 24 are engaged between the feet 54, 56 of the member 40, when the forklift tyne 61 enters or exits the sleeves 24, the members 40 are held in place and would not tend to slide with the forklift tyne as it enters and exits the sleeve 24 with the member 40 therein. So that to assure that the feet 54, 56 and 58 make contact with the surface, and not the sleeve 24, the central foot 58 protrudes from a slit 59 in the fabric of sleeve 24 so as to extend outward beyond the sleeve 24 and allow the bag to rest on the feet 54, 56 and 58 of the member 40.

Figure 6:
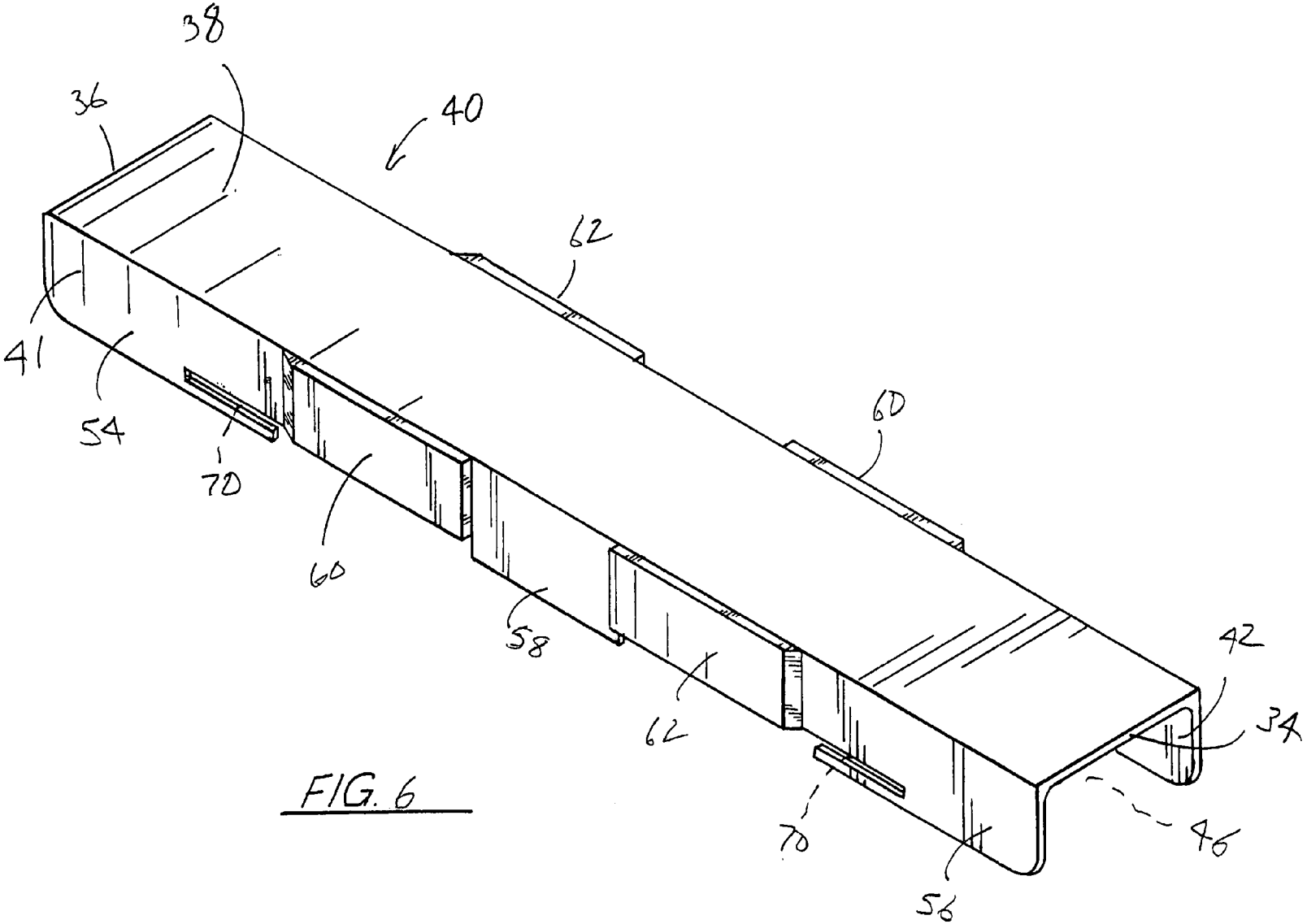
FIG. 6 illustrates a top view of an additional preferred embodiment of the U-shaped member of the present invention.

Reference is now made to FIGS. 6 and 7 which illustrate another embodiment of the member 40. This embodiment includes all of the features of the embodiment illustrated in FIGS. 3 and 4, with the exception that the feet members 54, 56 which are at the ends of members 40 extend a greater length as part of the walls 41, 42. As illustrated, there is then formed an open-ended slot 70 into the foot members 54, 56, defining a finger projection 71. So that, as seen in FIG. 7, when the member 40 is slid within the sleeve 24, rather than the ends of the sleeve 24 resting along the edge 55 of the feet 54, 56, a portion of each sleeve is slidingly engaged into each slot 70, and projection 71, as illustrated in FIG. 7. In this manner, the member 40 is held very secure in place within each sleeve 24, and, because of the other features of the raised members 60, 62 along the walls 41, 42 of each member 40, the sleeve is pulled tight along the underside of the member 40, and again, a well a travel space 65 is formed between the sleeve 24 and upper wall 38 of the member 40 resting against the bulk bag lower wall 12. Like the previous embodiment, this allows the tynes 61 of a forklift to enter and exit space 65 with ease, while at the same time preventing the possibility of the member 40 from being disengaged from the sleeve 24. Also, similar to the embodiment a illustrated in FIG. 5, the central foot 58 protrudes from a slit 59 in the fabric of sleeve 24 so as to extend outward beyond the sleeve 24 and allow the bag to rest on the feet 54, 56 and 58 of the member 40.

Figure 9:
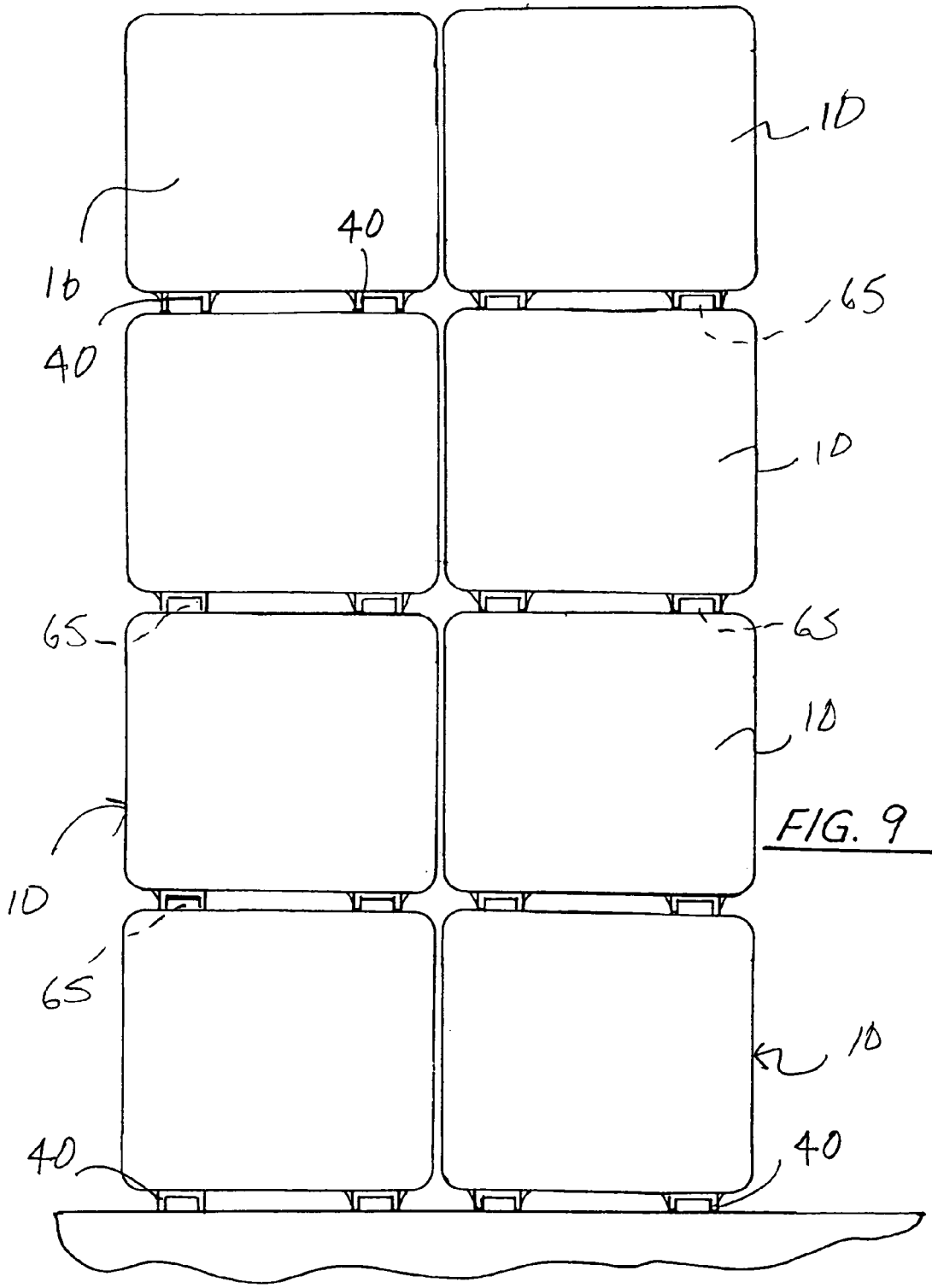
FIG. 9 illustrates a plurality of the improved bulk bags of the present invention stacked upon one another in rows in a rigid and secure manner.

Another critical function of the members 40 within sleeves 24 is the function of support in all of the embodiments of the members 40 as discussed previously. Most bulk bags need to be placed on pallets in order to be stacked. However, due to the nature of a pallet construction, the strength of a pallet is along is out perimeter, not across its center. This is not a favorable construction for supporting a filled bulk bag. Therefore, by utilizing the present invention, the pair of members 40 placed within the sleeves 24, in the manner as discussed previously, defines an improved portable pallet-like system that would accompany each filled bulk bag 10. Therefore, as seen in FIGS. 8 and 9, in addition to the members 40 allowing the tyne 61 of a forklift 63 to slide easily into and out of the space 65 defined between the member 40 and the sleeve 24, the pair of members 40 provide a flat, strong support base across the entire underside 12 of the bulk bag 10. The bulk bags 10 can then be stacked in the manner as seen in FIGS. 8 and 9, which is very secure, and offers a flat, strong surface upon which each bulk bag rests. Therefore, when a bulk bag needs to be moved, as seen in FIG. 9, the forklift tynes 61 are engaged into the pair of openings 65 formed by members 40, and the bulk bag 10 together with the pair of members 40 is transported and can be placed to rest upon its own improved pallet-like structure. When the bulk bags are shipped, the members 40 may be easily removed from the sleeves 24, nested together in a compact configuration, and then reinserted into the sleeves 24 when the bag reaches its destination.

PARTS LIST

The following is a list of suitable parts and materials for the various elements of the preferred embodiment of the present invention.

| | |
|---|---|
| bulk bag | 10 |
| underside | 12 |
| top wall | 14 |
| side walls | 16 |
| bag space | 18 |
| opening | 20 |
| fabric sleeves | 24 |
| edges | 25 |
| opening | 26 |
| two ends | 28, 30 |
| prior art support member | 32 |
| wall portions | 33, 35 |
| ends | 34, 36 |
| upper wall portion | 37 |
| support member | 40 |
| side portions | 41, 42 |
| corner | 43 |
| lower edge | 44 |
| opening | 46 |
| recessed areas | 50, 52 |
| feet | 54, 56, 58 |
| interior edges | 55 |
| slit | 59 |
| tynes | 61 |
| forklift | 63 |
| openings | 65 |

The foregoing embodiments are presented by way of example only; the scope of the present invention is to be limited only by the following claims.

What is claimed is:

1. An improved bulk bag of the type having side portions, an upper end portion, and a lower floor portion, comprising:

a) a pair of flexible sleeves positioned along an undersurface of the lower floor portion, and spaced sufficiently apart to each accept a tyne of a forklift therein; and b) a substantially rigid support member insertable into each flexible sleeve, the support members comprising slits formed in the walls of the support member for engaging a portion of the sleeve within the slits to maintain the support member within the sleeves, and defining an opening for receiving the forklift tynes and for further defining a stable base upon which to rest the bag when the bag is filled with bulk material; and c) recesses on each support member for engaging edges of the flexible sleeves for preventing the support members from sliding out of the sleeves during use.

2. The improved bulk bag in claim 1, wherein the support member further includes a flat top portion, positioned against the bag's lower floor portion, and a pair of side walls extending downward therefrom for receiving the forklift tynes therebetween.

3. The improved bulk bag in claim 1, wherein the recesses in walls of the support member for accommodating the sleeve edges within the recesses further define feet upon which the support member rests supporting a bag thereupon.

4. The improved bulk bag in claim 1, wherein the support member is formed of a plastic-type injection molded material.

5. The improved bulk bag in claim 1, further including raised members spaced along a length of each side wall to make a circumference of the recessed areas of each wall substantially equal to a circumference of foot portions of the member so that the sleeve is pulled tightly across the walls, to define an opening between the sleeve and the upper wall.

6. An improved bulk bag of the type having side portions, an upper end portion, and a lower floor portion, comprising:

a) a pair of flexible sleeves positioned along an undersurface of the lower floor portion, and spaced sufficiently apart to each accept a tyne of a forklift therein;

b) a substantially rigid support member insertable into each flexible sleeve which further comprises:

1) an upper wall of the support member positioned against an undersurface of the bag lower floor portion; and 2) side walls of a U-shaped member extending downward from the upper wall for defining a space within each member for receiving the forklift tyne, and for further defining a stable base upon which to rest the bag when the bag is filled with bulk material; and 3) slits formed in the walls of the support member for engaging a portion of the sleeves within the slits to maintain the support member within the sleeves.

7. The improved bulk bag in claim 6, further including raised members spaced along the length of each side portion so that a circumference of the recessed areas of each wall are substantially equal to a circumference of the foot portions of the member so that the sleeve is pulled tightly across the walls, to define an opening between the sleeve and the upper wall for maintaining the fabric within the recessed areas of the side walls.

8. The improved bulk bag in claim 6, wherein each support member further comprises recesses in walls of the support member for accommodating sleeve edges within the recesses for maintaining the support member engaged within the sleeve as a forklift tyne is moved in and out of the sleeves.

9. The improved bulk bag in claim 6, wherein the support member comprises injection molded plastic material which is geometrically designed to strengthen the members against deflection.

10. The improved bulk bag in claim 6, wherein the support member within the sleeves further defines a support base which can be easily removable from the bag during shipment and provides a compact plurality of sleeves nested together when shipped.

11. An improved bulk bag of the type having side portions, an upper end portion, and a lower floor portion, comprising:

a) a pair of flexible sleeves positioned along an undersurface of the lower floor portion, and spaced sufficiently apart to each accept a tyne of a forklift therein;

b) a substantially rigid support member insertable into each flexible sleeve, the support member defining an opening for receiving the forklift tyne and for further defining a stable base upon which to rest the bag when the bag is filled with bulk material;

c) recesses formed in the walls of the support member for engaging a portion of the sleeves when the support member is inserted into the sleeves for preventing the support member from sliding from the sleeves when contacted by forklift tynes; and d) raised members spaced along the length of each side wall so that a circumference of the recesses of each wall are substantially equal to a circumference of the foot portions of the member so that the sleeve is pulled tightly across the walls for maintaining the sleeve within the recesses of the side walls.

12. The improved bulk bag in claim 11, wherein the recesses in the walls of the support member for engaging the flexible sleeves further defines a plurality of feet for the support member to rest on a surface without the sleeves making contact with the surface.

13. The improved bulk bag in claim 11, wherein the support member further comprises slits formed in the walls of the support member for engaging a portion of the sleeves within the slits to maintain the support member within the sleeves.

* * * * *